US006009622A

United States Patent [19]

Liedblad

[11] Patent Number: 6,009,622

[45] Date of Patent: Jan. 4, 2000

[54] RAZOR CLEANING DEVICE

[76] Inventor: Thomas F. Liedblad, 333 So. Virginia Ave., Burbank, Calif. 91506

[21] Appl. No.: 09/019,579

[22] Filed: Feb. 6, 1998

[51] Int. Cl.[7] ..... B26B 21/40

[52] U.S. Cl. ..... 30/41; 30/34.05; 30/537

[58] Field of Search ..... 30/34.05, 41, 41.5, 30/537, 538, 539, 540, 541

[56] References Cited

U.S. PATENT DOCUMENTS

| | | | |
|---|---|---|---|
| 3,277,571 | 10/1966 | Bloomfield | 30/540 |
| 3,950,898 | 4/1976 | Bowen | 30/41 |
| 4,198,745 | 4/1980 | Moehlenpah | 30/34.05 |
| 4,712,300 | 12/1987 | Hemmeter | 30/41 |
| 4,974,319 | 12/1990 | Maguire, Jr. et al. | 30/41 |

*Primary Examiner*—Hwei-Siu Payer

[57] ABSTRACT

A razor cleaning device adapted for use in association with a conventional disposable razor having a blade and a shaft, the razor cleaning device comprising: a housing formed in a hollow configuration with a front face, a rear face, an upper end and a lower end, the front face and upper end including a contiguously formed recess; and a front block extending frontwardly from the lower end of the housing, the front block having an inboard region, an outboard region, two side edges and an upper surface, the upper surface of the inboard region including at least one water hole extending therethrough, in an operative orientation a user submerging the apparatus and razor in water and squeezing, this action causing water to be forced through the water holes of the inboard region thereby dislodging hair fragments from the blade of the razor.

14 Claims, 5 Drawing Sheets

RAZOR CLEANING DEVICE

BACKGROUND OF THE INVENTION

1. Field of the Invention

The present invention relates to a razor cleaning device and more particularly pertains to cleaning the blade of a razor by positioning the razor within the apparatus and squeezing while submerged in water.

2. Description of the Prior Art

The use of razor cleaners is known in the prior art. More specifically, razor cleaners heretofore devised and utilized for the purpose of cleaning razors are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,838,949 to Dugrot disclose a shaving razor cleaner.

U.S. Pat. No. 4,890,348 to Racioppi discloses a razor cleaning device.

U.S. Pat. No. 4,480,387 to d'Alayer de Costemore d'Arc discloses a cleaning device for razors.

U.S. Pat. No. 5,335,417 to Genero et al. discloses a hand razor.

U.S. Pat. No. 5,318,548 to Filshie discloses a mucus extractor.

While these devices fulfill their respective, particular objective and requirements, the aforementioned patents do not describe a razor cleaning device for cleaning the blade of a razor by positioning the razor within the apparatus and squeezing after filling the device with water by first squeezing and then releasing while the water inlet or inlets are submerged in water.

In this respect, the razor cleaning device according to the present invention substantially departs from the conventional concepts and designs of the prior art, and in doing so provides an apparatus primarily developed for the purpose of cleaning the blade of a razor by positioning the razor within the apparatus and squeezing after filling the device with water by first squeezing and then releasing while the water inlet or inlets are submerged in water.

Therefore, it can be appreciated that there exists a continuing need for new and improved razor cleaning device which can be used for cleaning the blade of a razor by positioning the razor within the apparatus and squeezing after filling the device with water by first squeezing and then releasing while the water inlet or inlets are submerged in water. In this regard, the present invention substantially fulfills this need.

SUMMARY OP THE INVENTION

In the view of the foregoing disadvantages inherent in the known types of razor cleaners now present in the prior art, the present invention provides an improved razor cleaning device. As such, the general purpose of the present invention, which will be described subsequently in greater detail, is to provide a new and improved razor cleaning device and method which has all the advantages of the prior art and none of the disadvantages.

To attain this, the present invention essentially comprises a new and improved razor cleaning device adapted for use in association with a conventional razor having a blade and a shaft, the razor cleaning device comprising, in combination: a housing fabricated of elastomeric materials and formed in a hollow generally rectangular configuration with a front face, a rear face, an upper end and a lower end, the front face being angled rearwardly from the lower end to the upper end, the front face and upper end including a contiguously formed arcuate recess; and a front block extending frontwardly from the lower end of the housing, the front block having an inboard region, an outboard region, two side edges and an upper surface, the upper surface of the inboard region including three water holes extending therethrough, the upper surface of the outboard region including two upwardly extending rectangular posts formed contiguously with the side edges, in an operative orientation a user positioning the blade upon the upper surface of the front block with the shaft positioned within the arcuate recess, the apparatus and razor adapted to be submerged in water and squeezed, this action causing water to be forced through the water holes of the inboard region thereby dislodging hair fragments from the blade of the razor. As best shown in FIGS. 4 & 5, further included is a valve means having an aperture formed in the lower end of the housing. An elastomeric flap is hingably coupled adjacent the aperture within an interior space of the housing. The flap has an unbiased first orientation situated slightly above the aperture and a biased second orientation situated against the flap. Next provided is a drainage means including a plurality of grooves formed in a bottom surface of the lower end of the housing. Each groove has a first end in communication with the aperture and a second end in communication with a periphery of the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved razor cleaning device which has all the advantages of the prior art razor cleaners and none of the disadvantages.

It is another object of the present invention to provide a new and improved razor cleaning device which may be easily and efficiently manufactured and marketed.

It is a further object of the present invention to provide a new and improved razor cleaning device which is of durable and reliable construction.

An even further object of the present invention is to provide a new and improved razor cleaning device which is susceptible of a low cost of manufacture with regard to both materials and labor, and which accordingly is then susceptible of low prices of sale to the consuming public, thereby making such a razor cleaning device economically available to the buying public.

Still yet another object of the present invention is to provide a new and improved razor cleaning device which provides in the apparatuses and methods of the prior art some of the advantages thereof, while simultaneously overcoming some of the disadvantages normally associated therewith.

Even still another object of the present invention is to provide a new and improved razor cleaning device for cleaning the blade of a razor by positioning the razor within the apparatus and squeezing after filling the device with water by first squeezing and then releasing while the water inlet or inlets are submerged in water.

Lastly, it is an object of the present invention to provide a new and improved razor cleaning device adapted for use in association with a conventional disposable razor having a blade and a shaft, the razor cleaning device comprising: a housing formed in a hollow configuration with a front face, a rear face, an upper end and a lower end, the front face and upper end including a contiguously formed recess; and a front block extending frontwardly from the lower end of the housing, the front block having an inboard region, an outboard region, two side edges and an upper surface, the upper surface of the inboard region including at least one water hole extending therethrough, in an operative orientation a user filling the apparatus with water and squeezing, this action causing water to be forced through the water holes of the inboard region thereby dislodging hair fragments from the blade of the razor. Filling of the device to be normally accomplished by squeezing the device and then releasing while keeping the water inlet and outlet ports submerged so that water is admitted to the device. An alternate filling means could be by simply filling the device by holding the inlet port under a running faucet.

These together with other objects of the invention, along with the various features of novelty which characterize the invention, are pointed out with particularity in the claims annexed to and forming a part of this disclosure. For a better understanding of the invention, its operating advantages and the m specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
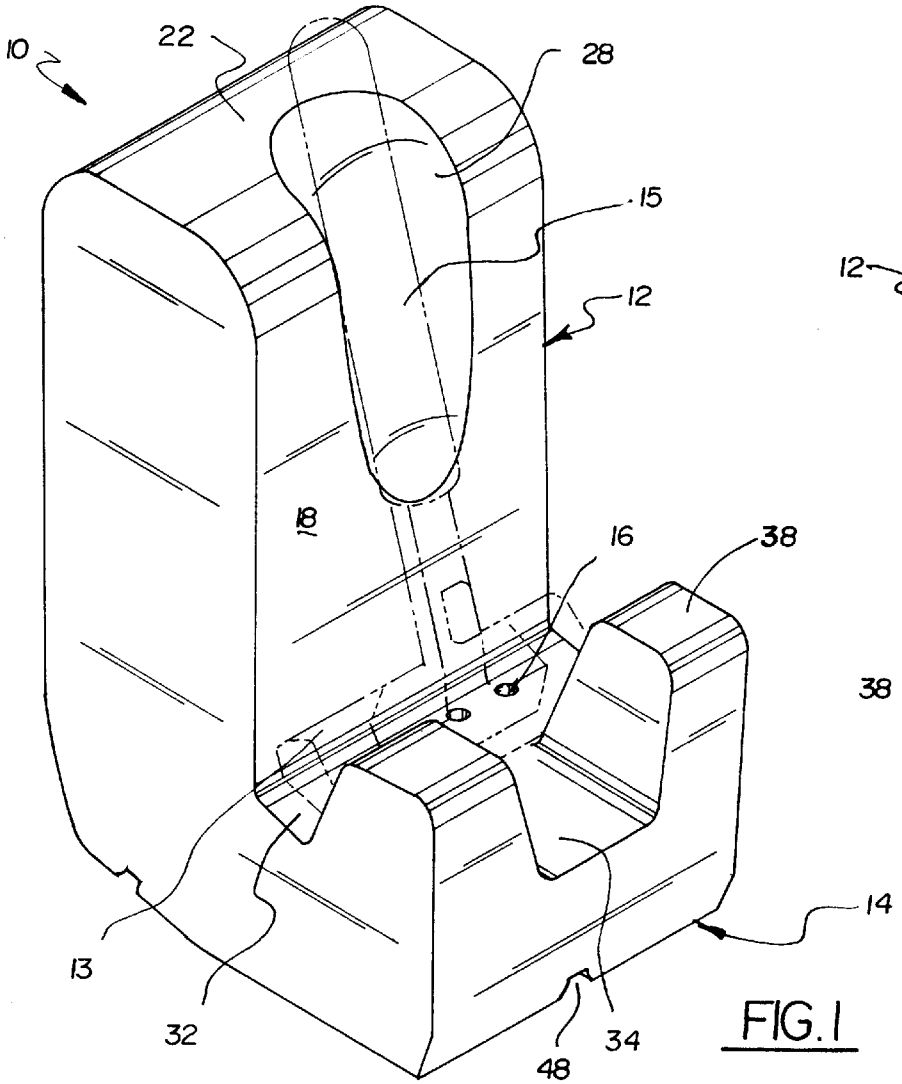
FIG. 1 is a perspective view of the preferred embodiment of the razor cleaning device constructed in accordance with the principles of the present invention.

With reference now to the drawings, and in particular, to FIG. 1 thereof, the preferred embodiment of the new and improved razor cleaning device embodying the principles and concepts of the present invention and generally designated by the reference number 10 will be described.

Specifically, it will be noted in the various Figures that the device relates to a new and improved razor cleaning device for holding a razor so that it can be cleaned. In its broadest context, the device 10 consists of a housing 12, a front block 14 and water holes 16. Such components are individually configured and correlated with respect to each other so as to attain the desired objective.

The razor cleaning device 10 is adapted for use in association with a conventional razor having a blade 13 and a shaft 15. The apparatus can accommodate regular or disposable razors, and either single or double edged blades.

Figure 3:
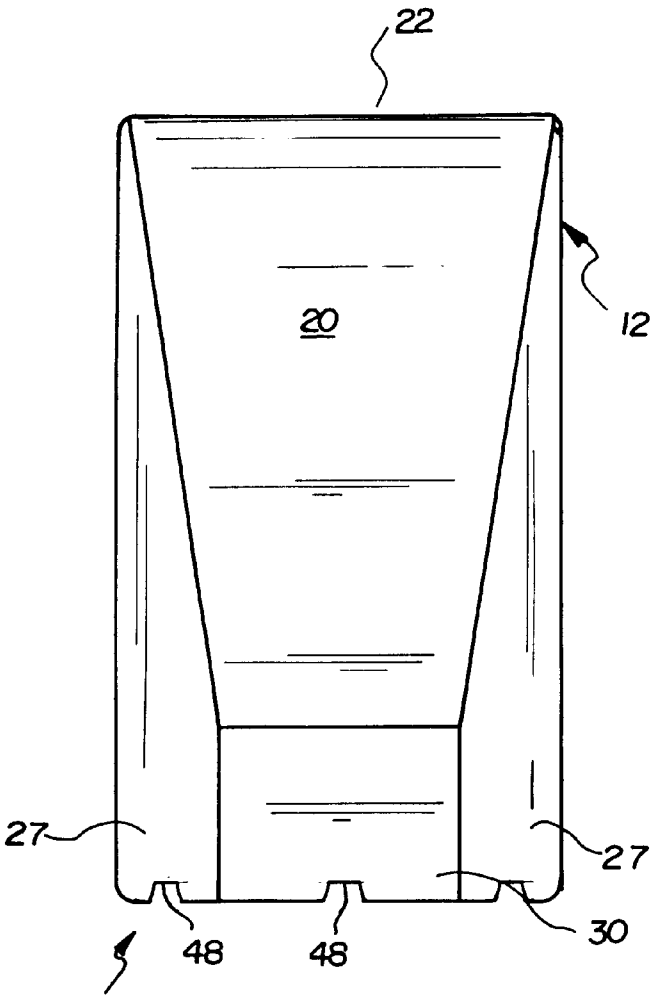
FIG. 3 is a rear elevational view of the present invention.

The housing 12 is fabricated of elastomeric materials, preferably plastic, and formed in a hollow generally rectangular configuration with a front face 18, a rear face 20, an upper end 22 and a lower end. The hollow interior 26 of the housing is filled with water in a stationary orientation. The front face 18 is wider than the rear face 20 causing the sidewalls 27 of the apparatus to be positioned in an angled orientation therebetween. Note FIGS. 1 and 3.

Figure 2:
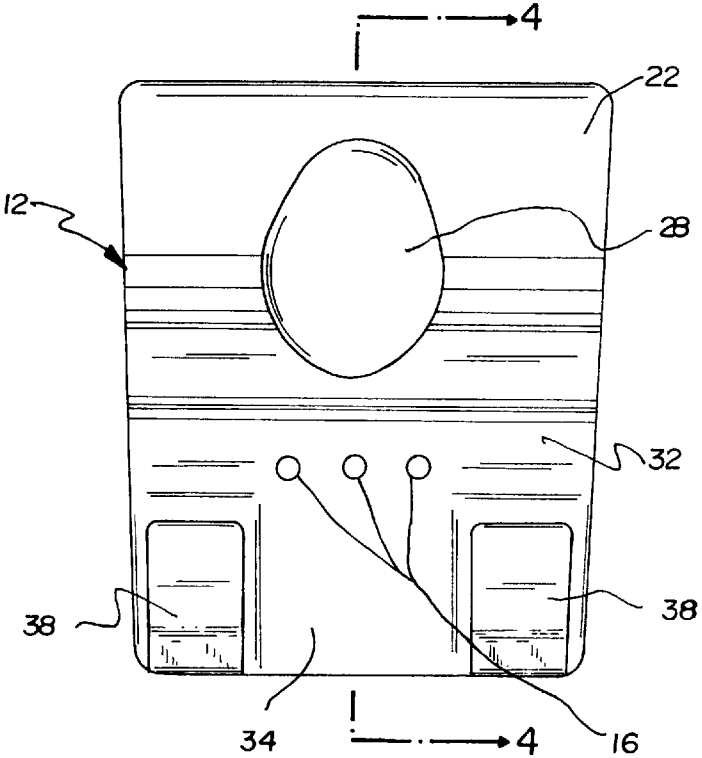
FIG. 2 is a plan view of the preferred embodiment of the present invention.

The front face 18 is angled rearwardly from the lower end 24 to the upper end 22. The front face 18 and upper end 22 include a contiguously formed arcuate recess 28. In an operative orientation the apparatus is orientated vertically with a razor positioned within it. The handle of the razor leans rearwardly and rests within the recess. The rear face 20 has an inwardly angled lower extent 30. The configuration of the rear face 20, sidewalls 27 and lower extent 30 allow for the comfortable positioning of the housing within a user's hand. Note FIGS. 2, 3 and 4.

A front block 14 extends frontwardly from the lower end 24 of the housing. The front block 14 has an inboard region 32, an outboard region 34, two side edges and an upper surface. The upper surface of the inboard region 32 includes three water holes 16 extending through it. The upper surface of the outboard region 34 includes two upwardly extending rectangular posts 38 formed contiguously with the side edges. The posts 38 are formed of solid elastomeric materials, preferably plastic. The posts 38 function to prevent the blade from slipping off the front block 14 during use of the apparatus. Note FIGS. 1 and 4.

Figure 4:
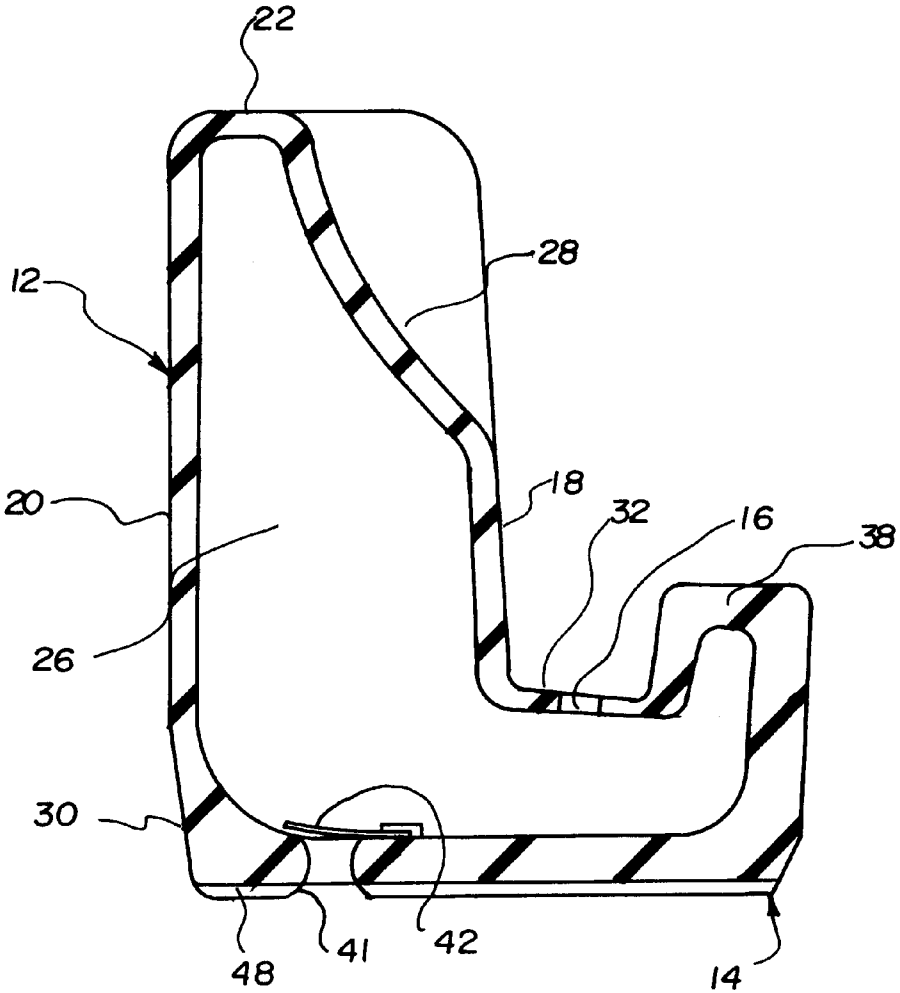
FIG. 4 is a cross sectional view taken along section line 4—4 of FIG. 2.
Figure 5:
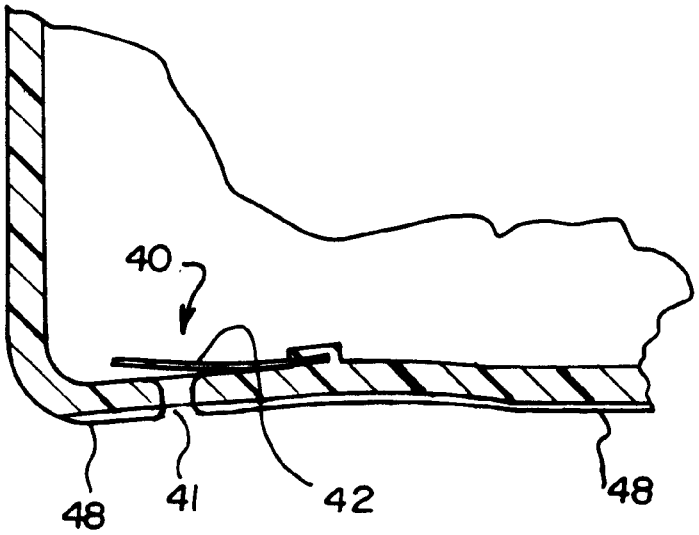
FIG. 5 is a cross sectional view of the valve means of the preferred embodiment of the present invention.

As best shown in FIGS. 4 & 5, further included is a valve means 40 having an aperture 41 formed in the lower end 24 of the housing. An elastomeric flap 42 is hingably coupled adjacent the aperture within an interior space of the housing. The flap 42 has an unbiased first orientation situated slightly above the aperture 41 and a biased second orientation situated against the aperture 41.

Next provided is a drainage means 46 including a plurality of grooves 48 formed in a bottom surface of the lower end 24 of the housing. Each groove 48 has a first end in communication with the aperture 41 and a second end in communication with a periphery of the housing. Preferably, a groove 48 extends outwardly to the front 18, rear 20, and side faces of the housing.

In use, the apparatus and razor are adapted to be submerged in water, squeezed and then released. The combination of these actions causes the flap to reside in the first orientation thereof and water to be forced through the water holes and aperture into the interior space of the housing. This is accomplished by the housing automatically returning to its original shape. The apparatus and razor are also adapted to be emerged from the water and subsequently squeezed thereby causing the flap to be forced into the second orientation thereof and water to be forced through the water holes thereby dislodging hair fragments from the blade of the razor. Finally, the apparatus and razor are further adapted to be placed on a counter whereby the flap resides in the first orientation thereof thus allowing excess water to be drained through the aperture 41 and drainage means 46.

Figure 7:
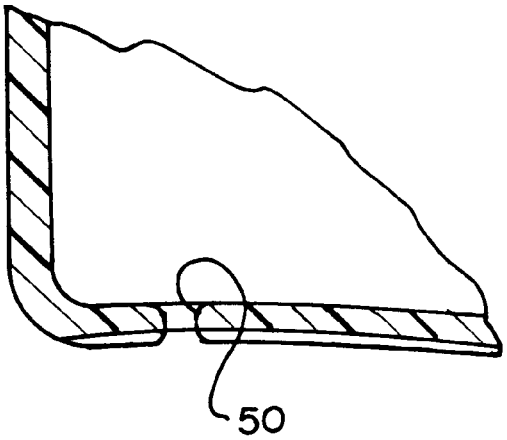
FIG. 7 is a cross sectional view of the valve means of another alternate embodiment of the present invention.

In an alternate embodiment shown in FIG. 7, an aperture 50 is formed in the lower end of the housing without any associated flap. In such embodiment, a user may selectively place his finger on the aperture to effect a valve. In the present embodiment, it is imperative that a user may plug the inlet aperture or apertures with a finger or fingers.

Figure 6:
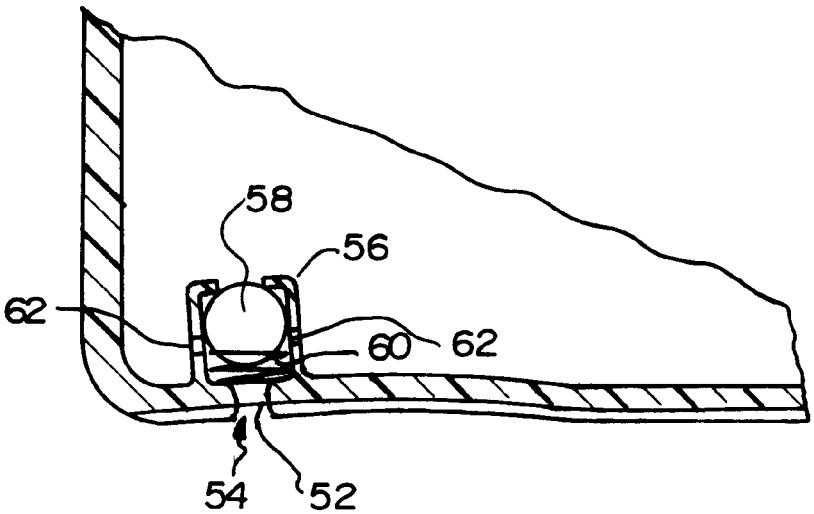
FIG. 6 is a cross sectional view of the valve means of an alternate embodiment of the present invention.

In another alternate embodiment shown in FIG. 6, the valve means includes an aperture 52 formed in the lower end of the housing and a ball and spring valve 54. The ball and spring valve 54 includes a cylindrical casing 56 with a top end and a bottom end in communication with the aperture 52. A ball 58 is biased upwardly toward the top end in a first orientation by a spring 60 situated between the housing and the ball 58. A pair of diametrically opposed bores 62 are formed in sides of the casing 56 between the ball 58 and the aperture 52. Such bores 62 allow communication between the interior space of the housing and the aperture 52 when the ball 58 is in the first orientation thereof. The ball 58 is adapted to be pushed downward in a second orientation as a result of the squeezing of the housing thereby blocking the aperture 52 and bores 62. As such, the bores 62 allow both water entry and drainage when appropriate and further permits water to exit only the water hole when the housing is squeezed. It should be noted that the flap and spring of the embodiments of FIGS. 5 and 6 respectively are designed to allow closing of the valve as a result of the pressure afforded by the squeezing of the housing.

Figure 9:
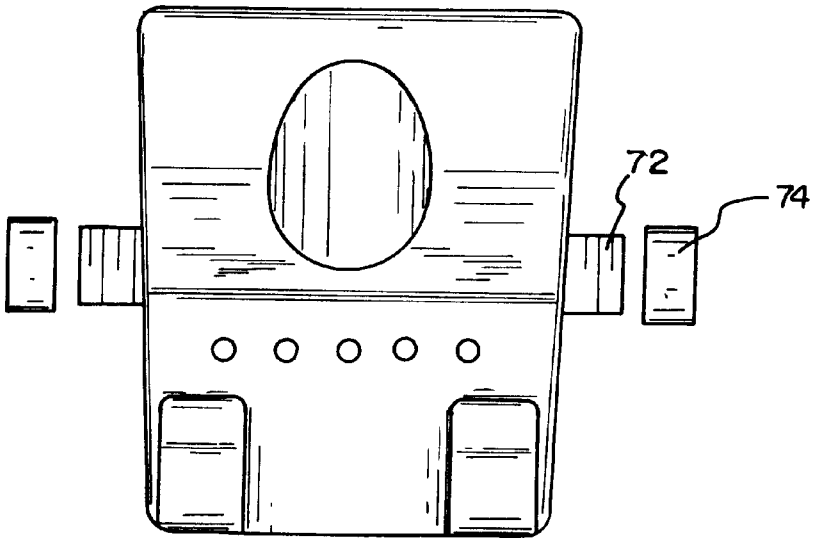
FIG. 9 is a modification of FIG. 8.
Figure 8:
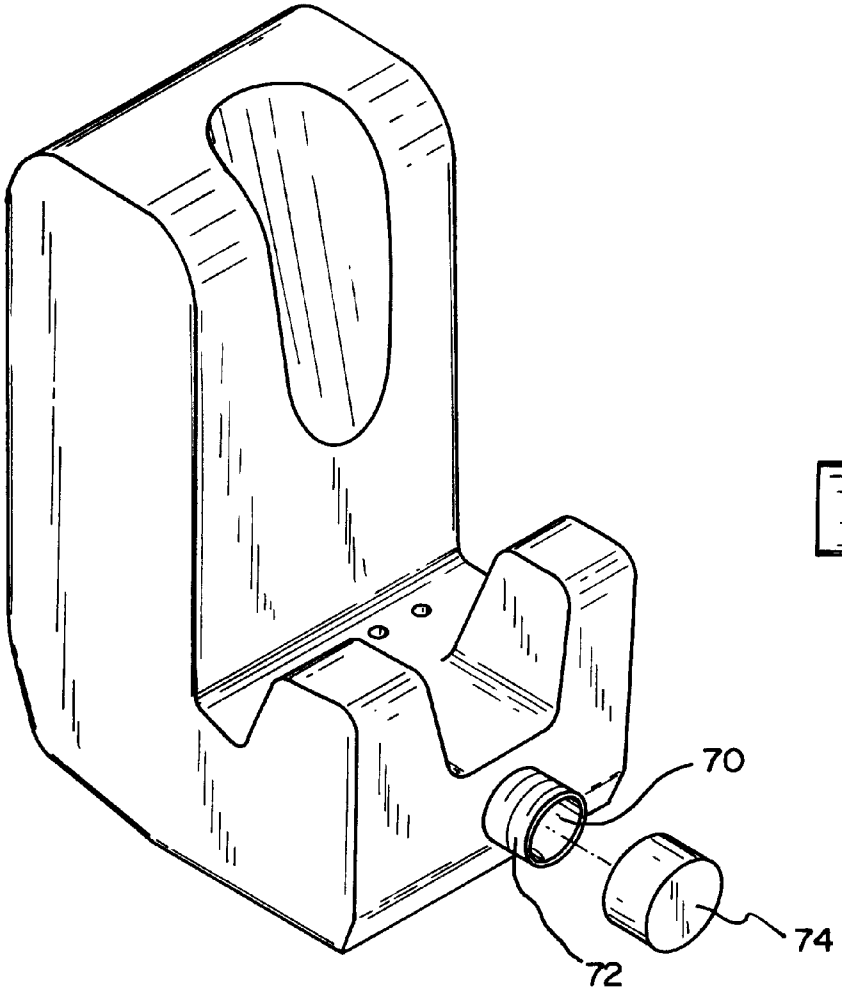
FIG. 8 is another alternative embodiment of the present invention.
Figure 10:
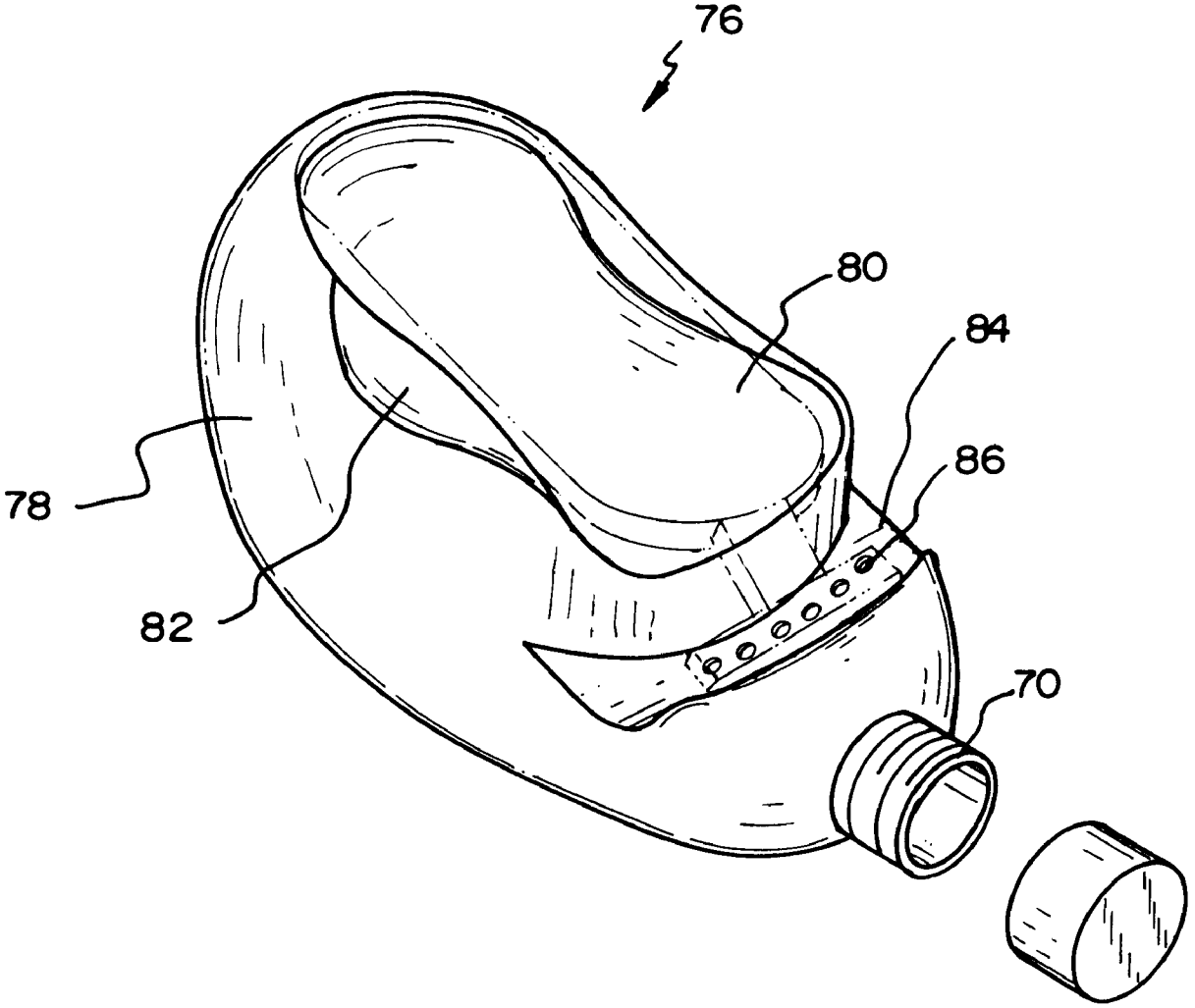
FIG. 10 is another alternate embodiment of the present invention.

In various additional embodiments, as shown in FIGS. 8–10, at least one aperture 70 is formed on the housing for allowing water to enter within and drained from the housing. Each of such apertures further serve to be plugged by a finger of a user while the housing is squeezed in a first mode of use. As an option, each aperture is equipped with a peripheral annular threaded lip 72 formed thereon for allowing the screwable in securement of a cap 74 thereon. As such, in a second mode of use, the caps may be secured in place after the housing is filled, whereafter the housing is simply squeezed. The caps may also be removed to allow the draining of the housing.

It should be noted that a single aperture as set forth hereinabove may be positioned on a front portion of the housing, as shown in FIGS. 8 & 10. In the alternative, each of the side faces of the housing may be equipped with an aperture. Note FIG. 9.

In yet another alternate embodiment 76, the housing 78 has a hollow generally ellipsoidal-shaped configuration. See FIG. 10. Situated on a top face of the housing 78 of the present embodiment is a peanut-shaped well 80 for allowing a women's razor to be removably positioned therein. At least one recess 82 is formed adjacent the periphery of such well for allowing a user to reach a finger beneath the women's razor to facilitate the removal thereof. An arcuate moat 84 is formed in the top face of the housing 78 for receiving the blade of the women's razor. Holes 86 are formed in the moat 84 for allowing water to spray the blade of the women's razor when the housing 78 squeezed. In additional alternate embodiments, the housing 78 may be configured to allow the razor to be mounted in an inverted orientation.

As to the manner of usage and operation of the present invention, the same should be apparent from the above 1description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved razor cleaning device adapted for use with a razor having a blade and a shaft, the razor cleaning device comprising:

a housing fabricated of elastomeric materials and formed in a hollow generally rectangular configuration with a front face, a rear face, an upper end and a lower end, the front face being angled rearwardly from the lower end to the upper end, the front face and the upper end including a contiguously formed arcuate recess;

a front block extending forwardly from the lower end of the housing, the front block having an inboard region, an outboard region, two side edges and an upper surface, the upper surface of the inboard region including at least one water hole extending therethrough, the upper surface of the outboard region including two upwardly extending rectangular posts formed contiguously with the side edges, in an operative orientation a user positioning the blade upon the upper surface of the front block with the shaft positioned within the arcuate recess;

valve means including an aperture formed in the lower end of the housing and an elastomeric flap hingably coupled adjacent the aperture within an interior space of the housing, the flap having an unbiased first orientation situated slightly above the aperture and a biased second orientation situated against the aperture;

drainage means including a plurality of grooves formed in a bottom surface of the lower end of the housing each with a first end in communication with the aperture and a second end in communication with a periphery of the housing;

whereby the device and the razor are adapted to be submerged in water, squeezed and then released, this action causing the flap to reside in the first orientation thereof and water to be forced through at least one water hole and the aperture into the interior space of the housing, the device and the razor are also adapted to be emerged from the water and subsequently squeezed thereby causing the flap to be forced into the second orientation thereof and water to be forced through at least one water hole thereby dislodging hair fragments from the blade of the razor, the device and the razor further adapted to be placed on a counter whereby the flap resides in the first orientation thereof thus allowing excess water to be drained through the aperture and drainage means.

2. A razor cleaning device adapted for use with a conventional disposable razor having a blade and a shaft, the razor cleaning device comprising:

a squeezable housing formed in a hollow configuration with a front face, a rear face, an upper end and a lower end; and a front block extending forwardly from the lower end of the housing, the front block having an inboard region, an outboard region, two side edges and an upper surface, the upper surface of the inboard region including at least one water hole extending therethrough, in an operative orientation a user submerging the device and the razor in water and squeezing, this action causing water to be forced through the at least one water hole of the inboard region thereby dislodging hair fragments from the blade of the razor.

3. The razor cleaning device as set forth in claim 2 wherein the front face in angled rearwardly from the lower end to the upper end.

4. The razor cleaning device as set forth in claim 2 wherein the upper surface of the outboard region includes two upwardly extending rectangular posts formed contiguously with the side edges.

5. The razor cleaning device as set forth in claim 2 wherein the front face and the upper end includes a contiguously formed recess.

6. A razor cleaning device adapted for use with a conventional disposable razor having a blade and a shaft, the razor cleaning device comprising:

a housing formed in a hollow configuration with an interior surface and an exterior surface and shaped to allow the mounting of the razor on the exterior surface; and at least one water hole formed in the housing and situated adjacent the razor when mounted thereon;

said housing being deformable as a result of the squeezing thereof.

7. The razor cleaning device as set forth in claim 6 and further including a valve means situated on the housing.

8. The razor cleaning device as set forth in claim 7 wherein the valve means includes an aperture formed in a lower end of the housing and an elastomeric flap hingably coupled adjacent the aperture within an interior space of the housing, the flap having an unbiased first orientation situated slightly above the aperture and a biased second orientation situated against the aperture.

9. The razor cleaning device as set forth in claim 8 and further including drainage means having a plurality of grooves formed in a bottom surface of the lower end of the housing each with a first end in communication with the aperture and a second end in communication with a periphery of the housing.

10. The razor cleaning device as set forth in claim 7 wherein the valve means includes an aperture formed in a lower end of the housing.

11. The razor cleaning device as set forth in claim 7 wherein the valve means includes an aperture formed in a lower end of the housing and a ball-and-spring valve.

12. The razor cleaning device as set forth in claim 6 and further including at least one aperture formed on the housing for allowing the housing to be filled with water and further being plugged by a finger of a user while the housing is squeezed.

13. The razor cleaning device as set forth in claim 12 and further including a cap removably secured over each aperture.

14. The razor cleaning device as set forth in claim 6 and further including at least one aperture for allowing the housing to be filled with water and being plugged by fingers of a user while the housing is squeezed, wherein each aperture has a peripheral annular threaded lip formed thereon for allowing the screwable securement of a cap thereon.

* * * * *